United States Patent [19]

Jordan

[11] Patent Number: 4,893,965

[45] Date of Patent: Jan. 16, 1990

[54] SYSTEM FOR OFFSHORE OPERATIONS

[76] Inventor: Peter A. Jordan, 'Rosslyn' Lower Road, Cookham Rise, Maidenhead, Berkshire, Great Britain

[21] Appl. No.: 124,103

[22] PCT Filed: Mar. 13, 1987

[86] PCT No.: PCT/GB87/00174

§ 371 Date: Mar. 3, 1988

§ 102(e) Date: Mar. 3, 1988

[87] PCT Pub. No.: WO87/05577

PCT Pub. Date: Sep. 24, 1987

[30] Foreign Application Priority Data

Mar. 13, 1986 [GB] United Kingdom ..... 8606225

[51] Int. Cl.[4] ..... E02B 17/02

[52] U.S. Cl. ..... 405/202; 405/195; 405/203; 166/350

[58] Field of Search ..... 405/202, 195, 203, 210, 405/204; 166/338, 340, 341, 350, 367, 359, 339; 114/265

[56] References Cited

U.S. PATENT DOCUMENTS

| | | | |
|---|---|---|---|
| 3,435,571 | 4/1969 | Oltermann et al. | 405/202 X |
| 3,766,582 | 10/1973 | Lloyd et al. | 405/202 |
| 4,026,119 | 5/1977 | Dotti | 405/202 |
| 4,142,820 | 3/1979 | Tuson | 405/202 |
| 4,470,723 | 9/1984 | Michel et al. | 405/202 |
| 4,529,334 | 7/1985 | Ortloff | 405/202 X |

FOREIGN PATENT DOCUMENTS

| | | | |
|---|---|---|---|
| 2100779 | 1/1983 | United Kingdom | 405/202 |

*Primary Examiner*—Dennis L. Taylor

*Attorney, Agent, or Firm*—Wolf, Greenfield & Sacks

[57] ABSTRACT

A system for offshore operations include a column 1 extending above sea level from the seabed, which is connected by a bridge 2 to a semisubmersible offshore oil production platform 3. The connection of the bridge 2 to the platform 3 is achieved by an improved joint arrangement which permits relative rotation about both substantially vertical and horizontal axes to reduce loads transmitted to the column. The column 1 is connected by a universal joint arrangement 4 to a base on the seabed. The joint 4 has radially outwardly distributed joint surfaces which provides an axial passageway through the joint for risers. The joint arrangement includes a first main joint and a second normally unloaded ball joint which takes up the column load in the event of failure of the first joint.

18 Claims, 9 Drawing Sheets

FIG.10.
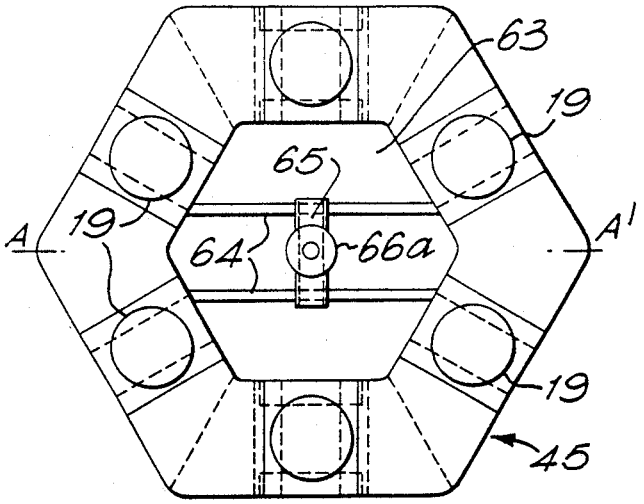
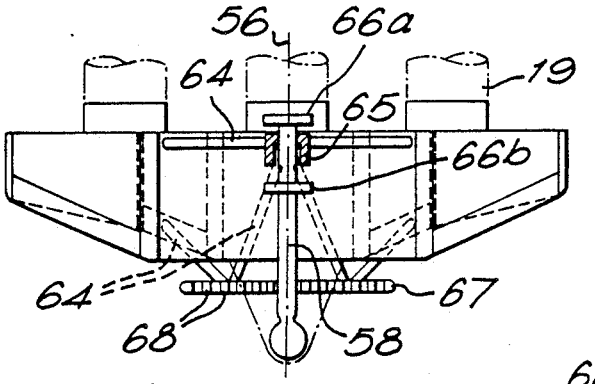
FIG.12.
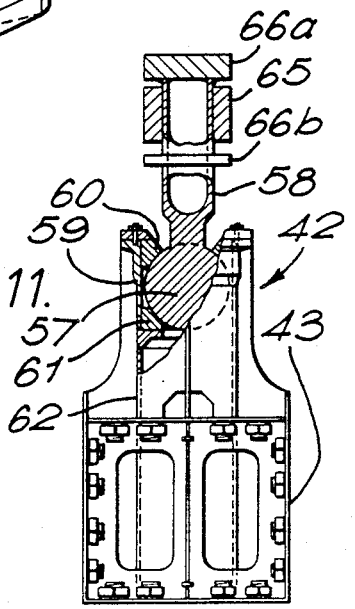
FIG.11.

FIG. 15.
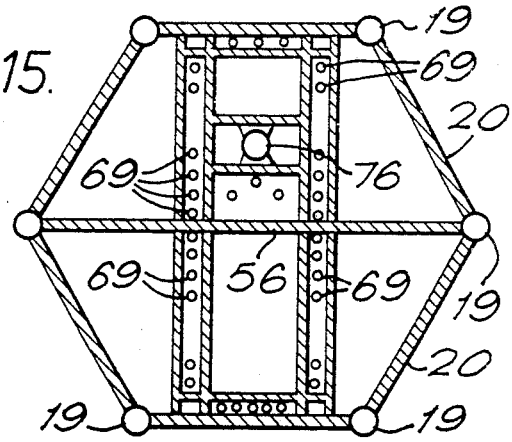
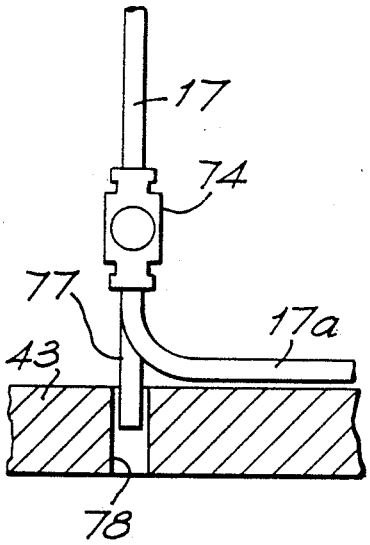
FIG. 16.
FIG. 17.
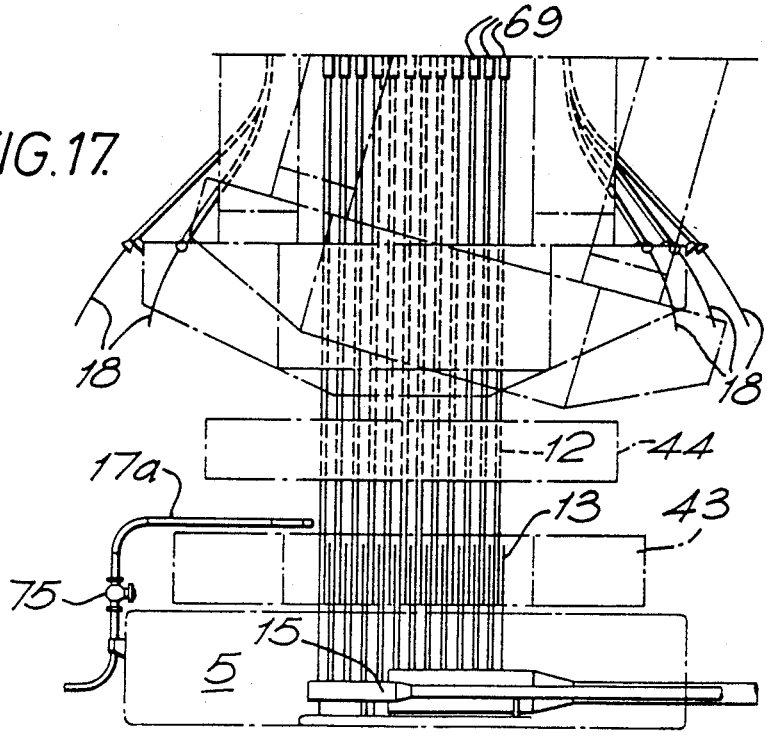

SYSTEM FOR OFFSHORE OPERATIONS

DESCRIPTION

This invention relates to a system for offshore operations, having particular application to oil and gas production from sub-sea wells.

It is known to use a buoyant steel column attached to the seabed to support oil and gas production risers extending from a sub-sea well to a surface vessel. The column is pivotally connected to a base attached to the seabed and remains substantially vertical by virtue of its buoyancy. The pivotal connection permits the column to rock in order to accommodate sea motion and the motion of the surface vessel. It is also known to connect the top of such a column by a rigid yoke to a surface vessel in such a way that the surface vessel is free to move in response to the waves and weathervane about the column so as to assume the line of least resistance to the prevailing weather conditions. It is also known to moor the vessel by this means.

It has recently been proposed to connect such a column by a hinged A-frame to a semisubmersible oil drilling and production platform moored by a plurality of catenary chains or wires. The A-frame is mounted at its feet on the semisubmersible by two horizontally spaced hinges allowing only vertical angular movement of the A-frame relative to the semisubmersible. The A-frame is connected to the column by a single joint located at the apex of the A-frame, the joint allowing relative rotation of column and A-frame about all three orthogonal axes. A problem with this arrangement is that the transverse forces applied by the column to the A-frame cause large transverse shear forces in the A-frame and large hinge forces at the hinge connection to the semisubmersible. These forces require a heavy A-frame which is difficult to disconnect safely in severe weather conditions.

With a view to overcoming this problem the present invention provides from first aspect an offshore system comprising a control column for extending upwardly from the seabed, a semisubmersible structure, and a bridge between the column and the structure, the bridge being connected to the semisubmersible structure by a joint arrangement which permits rotation of the bridge relative to the structure about both a substantially vertical axis and a substantially horizontal axis. Preferably the joint arrangement also permits relative rotation of the bridge and the semisubmersible structure about the longitudinal axis of the bridge. Thus, the loads applied through the bridge can be purely axial.

The bridge can consequently be much lighter than the A-frame arrangement previously proposed and leads to much simplified connection to the semisubmersible. The requirement to be able to connect the bridge to the semisubmersible offshore and to disconnect the bridge from the semisubmersible in emergency can be more easily achieved than with the bridge arrangements previously proposed.

Preferably the bridge is connected to the semisubmersible structure by a releasable hook arrangement. Conveniently the bridge is provided with generally horizontal pin, and the semisubmersible structure is provided with a hook arrangement with receptacles in which the pin is releasably received for pivotal movement. Preferably the pin is released from the hook arrangement by downward movement upon release of a hydraulic catch, so that the bridge can be manoeuvred by means of a cable from a winch on the semisubmersible.

In order to produce a convenient arrangement for the equipment located on the top of the column and to be able to stow the bridge on the column, the bridge is preferably connected to the column by a joint located at the edge of the column and not on its vertical axis. The problem with this arrangement is that axial forces induced in the bridge by differences in environmental loadings applied to the semisubmersible and the column result in moments being produced in the column when the compass heading at the bridge is such that the axis of the bridge does not pass through the axis of the column. Such moments would produce unacceptably high stresses and strains on prior art pivotal connections between the column and its base, which could lead to failure of the joint. If the joint were to break, the column would move away from the base and rupture the risers, with the risk that substantial amounts of oil and gas would be released into the sea.

In accordance with the second aspect of the invention, an improved connection is provided between the column and the base.

In accordance with the second aspect of the invention there is provided a control column for offshore operations comprising a base for attachment to the seabed, a column for articulation to the base to extend upwardly therefrom, the articulation including a universal joint having a plurality of rotary joint surfaces disposed radially outwardly of the longitudinal axis of the column.

By positioning the joint surfaces radially outwardly of the column axis, the universal joint is able to resist the stresses produced by the aforesaid applied torques. Also, the disposition of the joint surfaces permits a central opening to be provided at the bottom of the column through which risers may extend.

In a preferred form, the universal joint comprises a column foot beam on the column, a cardan ring rotatably mounted on the column foot beam about a first axis, the ring also being mounted on the base for rotation about a second axis transverse to said first axis. Conveniently, the cardan ring is mounted for rotation about the second axis on a base connection beam itself mounted on the base.

Also, according to the second aspect of the invention there is provided a control column for offshore operations comprising a base for attachment to the seabed, a buoyant column for articulation to the base and to extend upwardly therefrom, the articulation including a first universal joint for normally being loaded by the column, and a second universal joint preferably normally substantially unloaded by the column but arranged to assume the column load upon failure of the first joint.

This arrangement according to the invention prevents riser damage in the event of failure of the first universal joint. Conveniently, the first universal joint comprises the cardan ring arrangement described above, and the second universal joint comprises a ball joint disposed axially of the column. The ball joint may comprise a ball member received in a socket member, said members being mounted on the base connection beam and the column foot beam. Conveniently, the ball member may include a tubular extension mounted for limited sliding movement relative to the column foot beam. The arrangement is such that in normal operation, the load of the column is carried by the first universal joint but in the event of failure thereof, the column moves upwardly so as to produce a sliding movement between the column foot beam and the tubular portion of the ball member, until the second universal joint becomes loaded by the column. Preferably the first universal joint incorporates features that allow it even when broken to withstand lateral environmental loads applied to the column, so that the second joint is only called upon to resist load components parallel to the column axis.

Furthermore the invention provides a control column for offshore operations comprising a base for attachment to the seabed, a column for articulation to the base to extend upwardly therefrom, the articulation including a universal joint so arranged that it is always loaded in compression and is so arranged that any single crack through the full section of any individual member of the joint will not lead to failure of the joint in any weather condition up to the worst storm that would be likely to occur with a frequency of once every three years.

In accordance with a third aspect of the invention, an improved riser arrangement is provided, as will now be explained.

In order to connect the oil and gas conduits on a buoyant articulated column to the oil and gas conduits on the seabed, flexible hoses or fluid swivels mounted coaxially with the universal joint spindles have been required hitherto.

According to the present invention there is provided a control column for offshore operations comprising a hollow column connected to a base by a hollow universal joint, with piping extending over the base and connected to the piping in the column, the arrangement permitting the column piping to be located close to the column axis so as to reduce the vertical relative movements of the column piping and base piping for a given column inclination. This permits the use of alternative methods for providing the flexible elements in the piping.

More particularly according to the invention, there is provided a manifold and control column for offshore operations, comprising a base for attachment to the seabed, a buoyant column articulated to the base by a universal joint so as to extend from the base toward the sea surface, the universal joint having an opening therein along the axis of the column, at least one riser including a column portion extending along the column, a base portion extending across the base and a portion joining the base portion and the column portion, said portions all being formed of metal tube. The riser supporting arrangement is so arranged that despite the fact that it is made of metal tube, it can accommodate rocking movement of the column without fracture and that no ball joints or flexible hoses are required.

Conveniently, the base portion of the riser is received on a cradle pivotally mounted on the base to allow movement of the riser due to rocking motion of the column about the universal joint. The base portion of the riser may include a loop portion adjacent the pivotal axis of the cradle in order to increase resilience of the riser to rocking movement of the column.

Also, according to the invention there is provided a control column for offshore operations comprising a hollow column connected to a base by a hollow universal joint, with piping extending over the base and connected to piping within the column by means of at least one pivotal pipe joint within the universal joint. Preferably said pivotal joint comprises a ball joint.

Preferably the ball joints are arranged on resilient mounts to accummulate vertical movement of the piping upon rotational movement of the column.

In order that the invention may be more fully understood and carried into effect an embodiment thereof will now be described by way of example with reference to the accompanying drawings in which:

FIG. 10 is a more detailed view of the column foot beam shown in FIGS. 1 and 6;

FIG. 11 is a more detailed sectional view of the universal ball joint 69 shown in FIGS. 1 and 6;

FIG. 12 is a sectional view of the column foot beam taken along the line A-A' of FIG. 10;

FIG. 15 is a schematic horizontal section through the column 1;

FIG. 16 is a schematic enlarged section showing the mounting of the ball joints 75;

FIG. 17 is a schematic vertical section through the column, taken at right angles to the section shown in FIG. 14;

Figure 18:
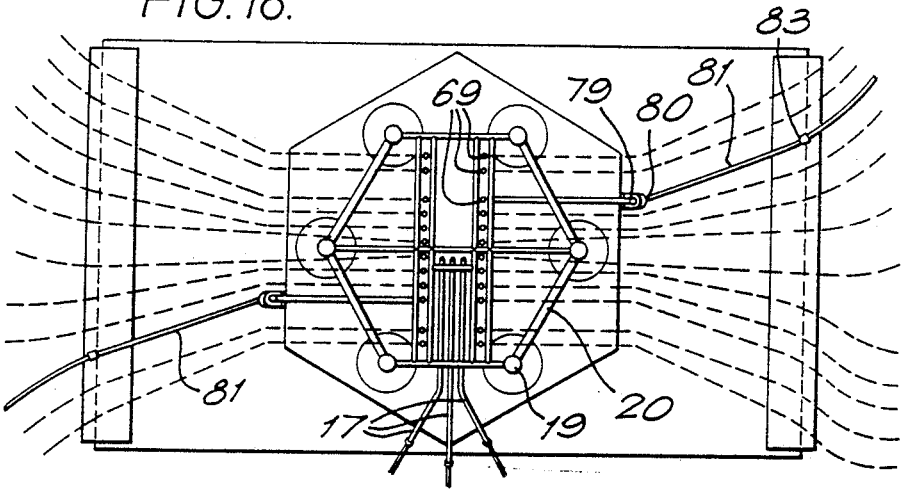

FIG. 18 (is a schematic plan view of an alternative riser arrangement; and

Figure 19:
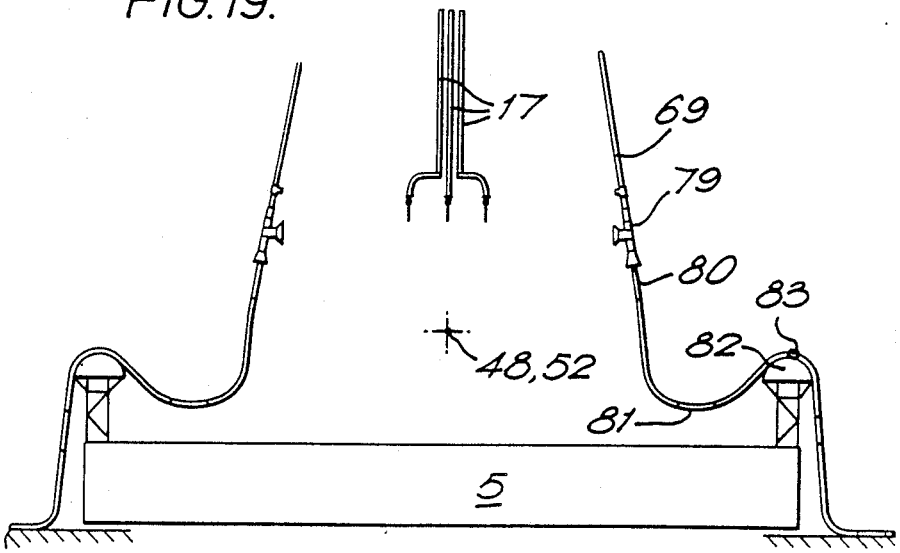

FIG. 19 is a schematic elevational view of the riser arrangement of FIG. 18, at the bottom of the column.

Figure 1:
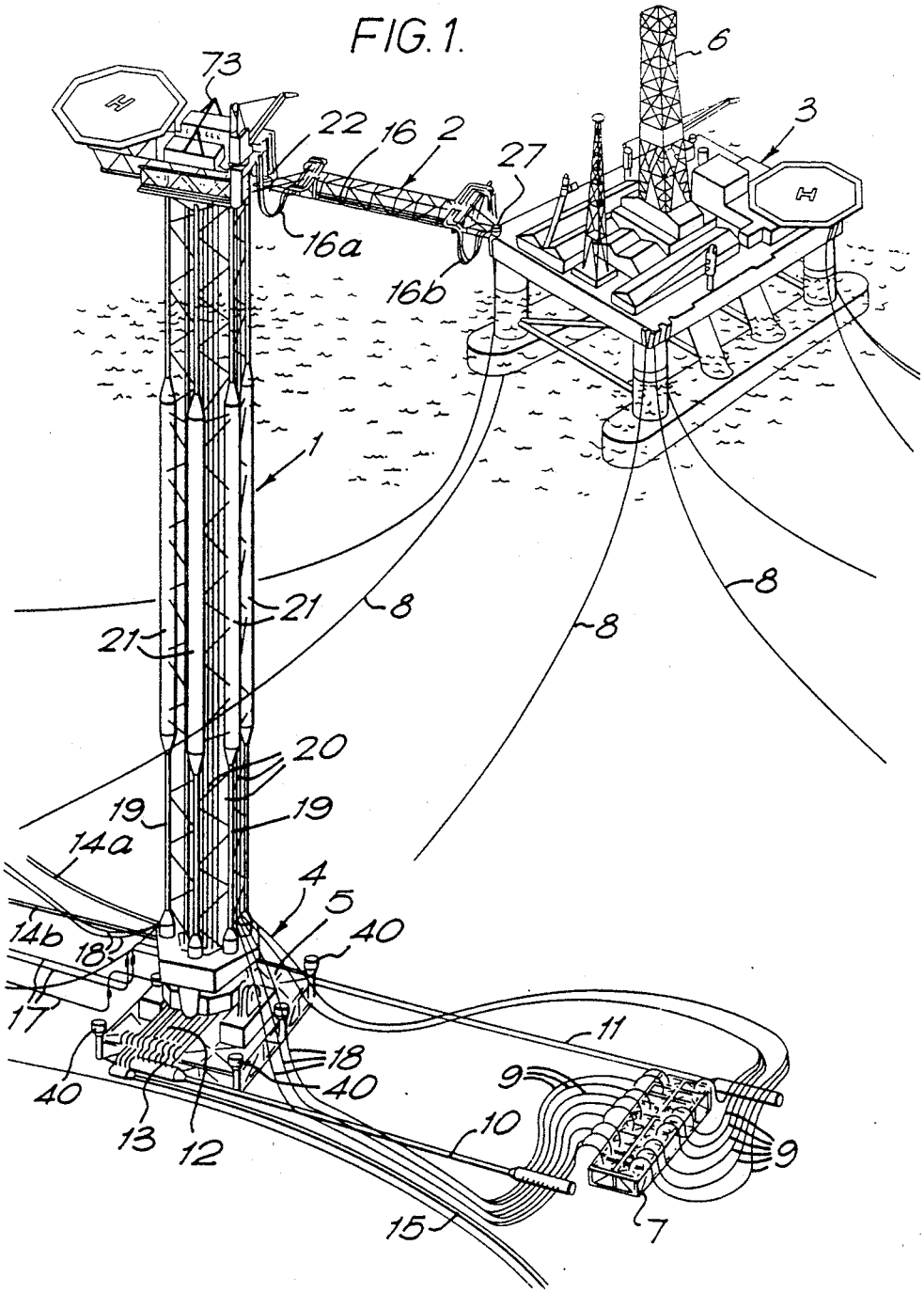
FIG. 1 is a general schematic perspective view of an offshore oil production facility.

FIG. 1 shows the general arrangement of the column structure in an offshore oil production facility Column 1 is connected by a bridge 2 to a semisubmersible offshore oil production platform 3. The column 1 is connected by a universal joint arrangement 4 to a base 5 on the seabed. The oil production platform 3 has a drilling rig 6 which has been used to drill production wells through a template 7 disposed on the seabed. The production platform is held on location over the template by a resilient mooring system comprising conveniently a plurality of wires and/or chains 8 connected to anchor points on the seabed. The length of these wires or chains can be adjusted by hauling in or paying out the wires or chains 8 from the rig so as to be able to locate the drilling rig on the production vessel over any desired well slot in the template.

Oil from the wells can be fed through flexible hoses 9 to a series of production flow lines in the form of tubes contained within casings 10, 11 that extend from the base 5 to adjacent the well. These tubes and casing may be made of metal of flexible materials. The flexible hoses 9 may also carry to the wells water or gas injection and also other controls too. Alternative connection configurations are possible and will be apparent to those skilled in the art. As can be seen in FIG. 1, the flow lines from the casing 10 extend across the base 5 as a series of steel tubes 12 containing loops 13 that provide resiliency as will be explained hereinafter. Similarly, the flow lines from the casing 11 extend across the base from the opposite side. The flow lines extend as risers 12 up the inside of the column .1. Oil from other production sites is also fed to the column 1. Casings 14*a*, 14*b* and a casing 15 extend from remotely disposed oil wells along the seabed, the casings 14*a*, 14*b* and 15 containing further flow lines which extend across the base 5 and up as risers through the column 1.

A valving arrangement is provided at the top of the column 1 to combine the production flow from the various risers. The oil and gas is fed through pipes 16 which extend across the bridge 2 to the production platform 3. The pipes 16 include jumper hoses 16*a*, 16*b* to accommodate relative movement of the bridge 2, the column 1 and the platform 3. The oil is processed on the platform 3 and then fed back to the top of the column 1. The oil and gas is then fed through export flow lines down through the column 1 and across the seabed through flow lines 17 to a remote location, e.g. on shore.

Also, a plurality of hydraulic control lines 18 extend down the column to the well heads e.g. at the template 7, the lines 18 being connected to the various wells to apply control pressures for controlling oil production rates, as is well known in the art.

Considering now the structure of the column 1, preferably it consists of six hollow, steel legs 19 interconnected by steel latticework 20 and arranged as a regular hexagon, the legs 19 each including an intermediate buoyancy section 21. The section 21 is disposed below the portion of the column subjected to wave action so as to minimise changes in buoyancy and bending moments in the column due to wave action.

The effect of the buoyancy section 21 is to cause the column 1 to turn about joint 4 to an upright position. The height of the column 1 will be selected depending upon the water depth at the site. Typically the height of the column will be in the range of 150 to 450 meters.

Figure 2:
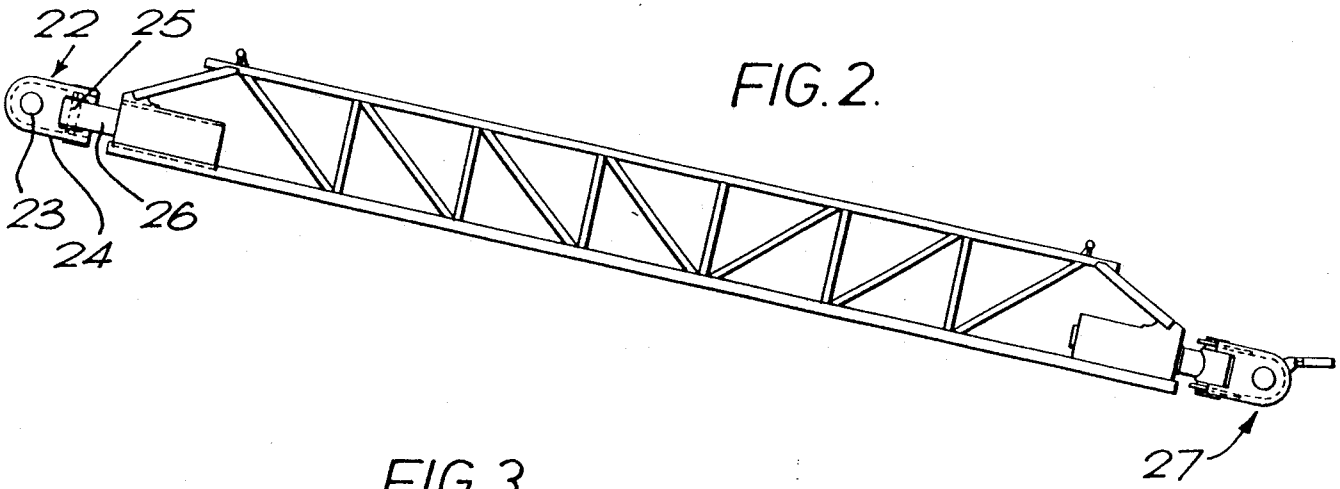
FIG. 2 is an enlarged elevational view of the bridge 2 shown in FIG. 1.

Referring now to FIG. 2, the connection of the bridge 2 to the column 1 and the platform 3 is shown in more detail. A universal joint 22 connects the bridge 2 to the column 1. The joint 22 consists of a horizontally disposed pin 23 attached to the column which provides an axis of rotation for a yoke 24 in which is mounted an orthogonal pin 25 that provides a rotational mounting for yoke 26 attached to the main structure of the bridge.

The opposite end of the bridge 2 is connected to the offshore platform 3 by a releasable universal joint arrangement 27. The joint arrangement 27 is shown in more detail in FIG. 3 and 4.

Figure 4:
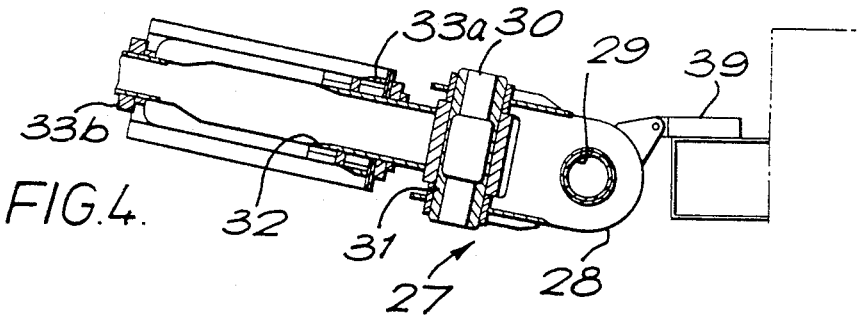
FIG. 4 shows a universal joint in the coupling of FIG. 3.
Figure 5:
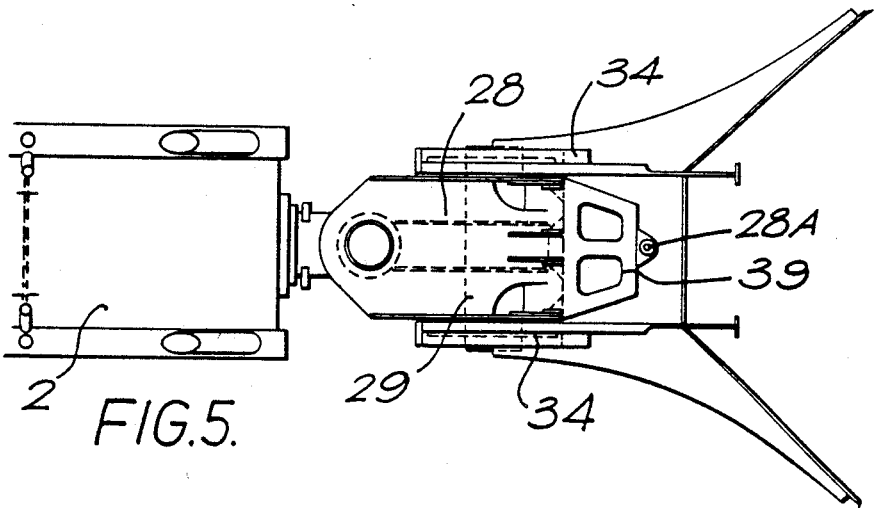
FIG. 5 is a plan view of the arrangement shown in FIG. 4.

Referring to FIG. 4, this shows the pivotal connections of the joint 27. A yoke 28 receives a generally horizontally disposed pivot pin 29 and is itself mounted for rotation about an orthogonally generally upright axis defined by a pivot pin 30. The pivot pin 30 is rotatably received in a bushing 31 mounted on yoke 28. A tubular extension 32 is rotatably received in the bushings 33*a*, 33*b* for rotation about an axis extending longitudinally of the bridge.

Figure 3:
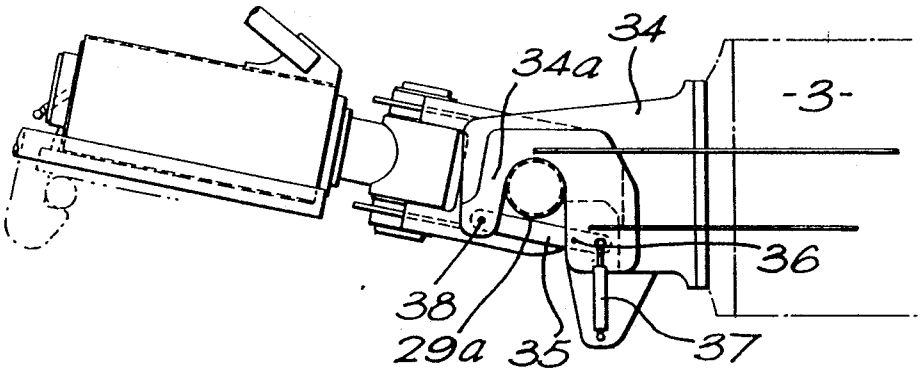
FIG. 3 is an enlarged elevational view of the coupling of the bridge to the platform 3.

As can be seen from FIG. 3, the pin 29 is releasably received in a cast steel elephant hook arrangement which includes a pair of horizontally spaced apart elephant hooks 34 mounted on the production platform 3. The yoke 28 fits between the hooks 34 so that the ends of the pin 29 are received in generally U-shaped hook parts 34*a* of the hooks 34. The pin 29 is received in and is rotatable with respect to a housing 29*a* which fits into the jaw of the elephant hook 34. The pin 29 is held in place by means of latch plates 35 pivotally mounted at 36 on the elephant hook 34. The latch plates 35 can be pivotted clear of the opening to the recess 34*a* by means of hydraulic actuators 37, upon removal of a safety pin 38.

Thus, the bridge is free to pivot at both ends by means of the universal joints 22, 27. Moreover, since the joint 27 permits the bridge to pivot about a generally vertical axis, stresses on the platform 3 are reduced compared with the prior art A-frame previously mentioned.

The bridge 2 can be released from the platform 3 by withdrawal of the pins 38 and operation of the actuators 37. A cable (not shown) extending from a winch on the platform 3 is attached to the bridge 2 at 28*a* to enable it to be lowered in a controlled manner upon operation of the actuators 37. Also, the bridge may be provided with a lifting yoke 39 which permits attached universal joint and pin 29 into the elephant hook.

Referring again to FIG. 1, the base 5 consists preferably of a steel latticework construction which is attached to the seabed by means of a steel tubes 40 that are grouted into the seabed.

As previously mentioned, the column 1 is connected to the base 5 by the joint 4 which will now be described in detail.

Figure 6:
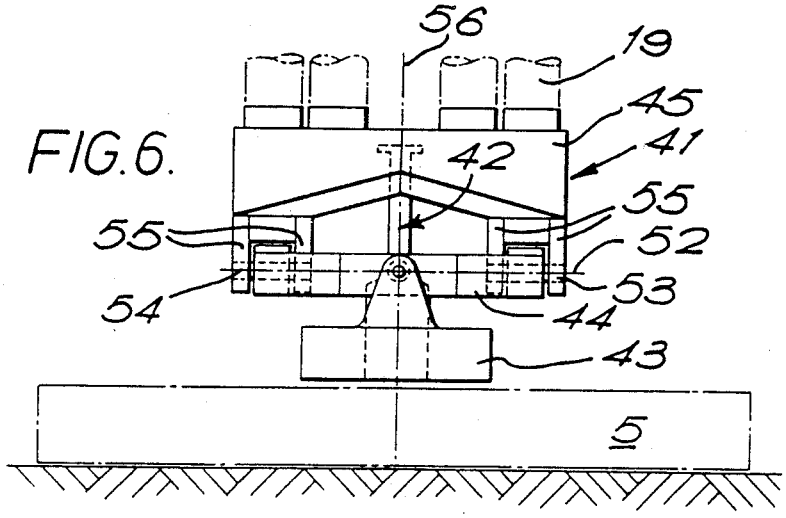
FIG. 6 is a schematic elevational view of the universal joint arrangement of FIG. 1.

Referring to FIG. 6, the joint 4 consists of first and second universal joints 41, 42. The joint 41 is based upon the cardan ring principle whereas the joint 42 is a ball and socket joint received within the cardan ring joint 41.

Figure 7:
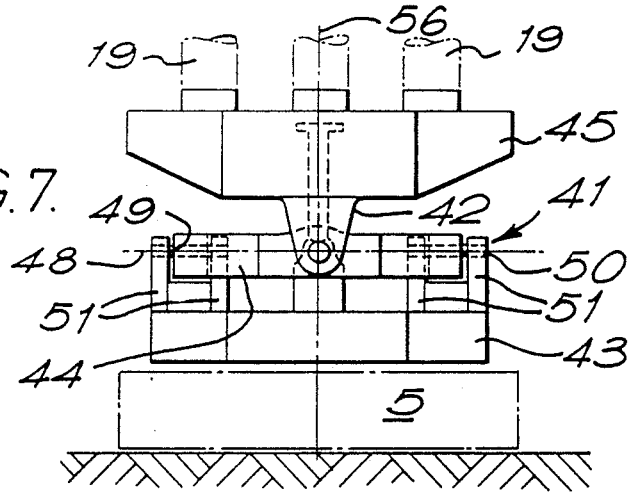
FIG. 7 is a schematic elevational view of the joint arrangement, given at right angles to the view of FIG. 6.

As can be seen in FIGS. 6 and 7, the cardan ring joint 41 consists of a generally H-shaped base connection beam 43, a cardan ring 44 and a polygonal column foot beam 45 attached to the bottom of the column legs 19.

Figure 8:
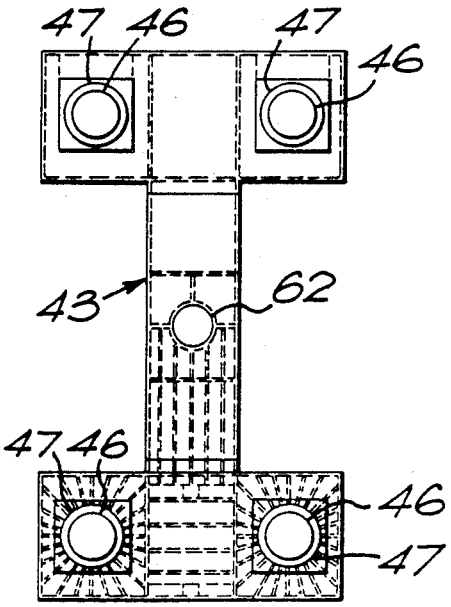
FIG. 8 is a more detailed view of the base beam shown in FIG. 6 and 7.

The base connection beam 43 is shown in more detail in FIG. 8 and comprises a box girder beam which is supported on the base 5 by four upwardly extending tubular base connection posts 46 that are received in tubular receptacles 47. Typically, the posts 46 have a diameter of 2 meters. Pins (not shown) extend through the receptacles and the posts 46, 47 to hold the beam in place in the event of loads which cause beam to lift from the base or overturn the base connection beam.

Referring to FIGS. 6 and 7, the cardan ring 44 is pivotally mounted on the base beam 43 so as to permit relative rotation of 44 and 43 about an axis 48. To this end, a pair of steel spindles 49, 50 are received in two pairs of yokes 51, received on the base beam 43. The cardan ring 44 is similarly pivotally mounted on the column foot beam 45 as to permit relative rotation of 44, 45 about an axis 52 extending orthogonally of the axis 48. Forged steel spindles 53, 54, are received in two yoked lugs 55 mounted on the column foot beam 45. The spindles 49, 50, 53, 54 may conveniently be received in self-lubricating bronze bushes (not shown) fitted into the yoked lugs.

Figure 9:
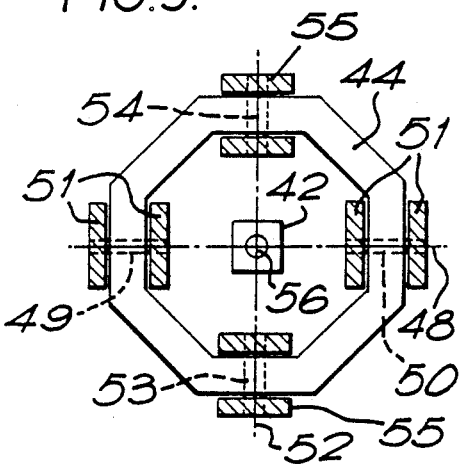
FIG. 9 is a plan view of the cardan ring shown in FIGS. 1 and 6.
Figure 13:
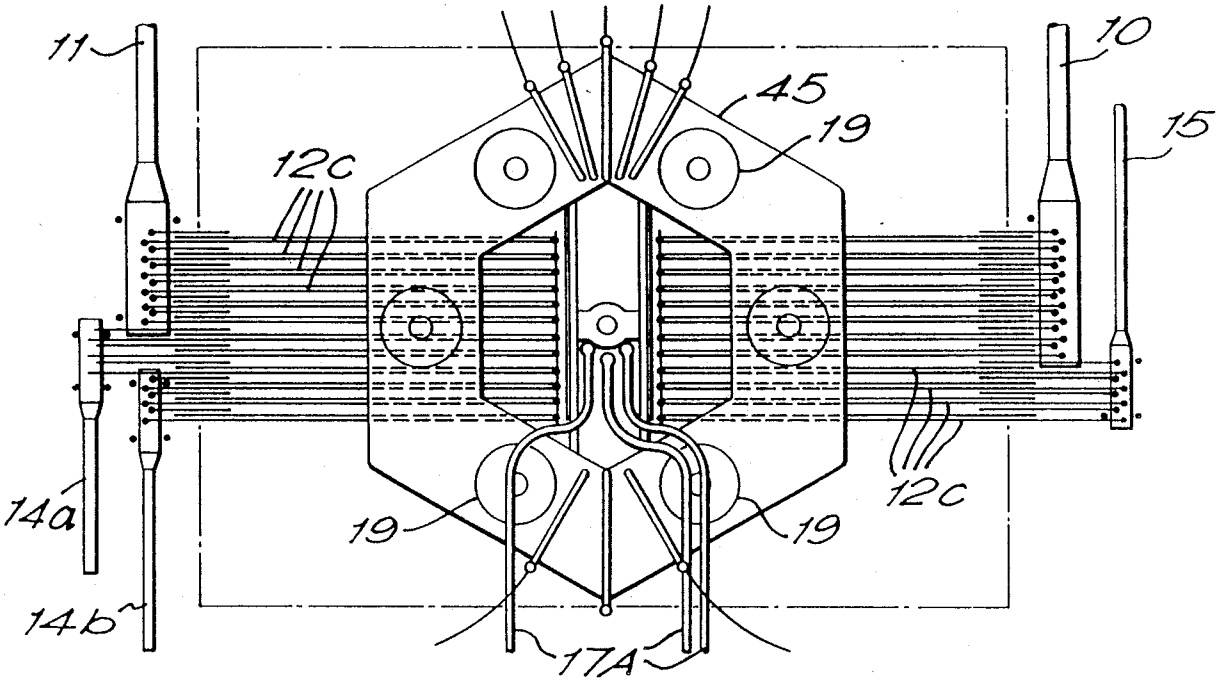
FIG. 13 is a schematic plan view of the column showing the riser arrangement.

The configuration of the spindle arrangement is shown in more detail in FIG. 9. It will thus be appreciated that the spindles 49, 50, 53, 54 constitute joint surfaces which are disposed radially outwardly of the column axis 56. This has two important advantages. Firstly, it provides an opening centrally of the column through which the risers 12 and 17 can extend. Also, it provides a joint which is resistant to torques applied about the column axis 56. An explanation of how torques are in use applied to the column will now be given.

Referring again to FIG. 1, environmental forces will act upon both the column 1 and the production platform 3. These forces will cause motions of the production platform 3 relative to the column 1. These motions will sometimes result in a changed relative position of the production platform and the column and a changed compass heading of the longitudinal axis of the bridge 2. Additionally, deliberate adjustments of the mooring lines 8 of the production platform 3 can be made at any time and these adjustments would cause the production platform 3 to take up a different position relative to the column 1 which will also alter the compass heading of the bridge 2.

The universal joint 22 (FIG. 2) which connects the bridge 2 to the column 1 is (as shown) conveniently located in a position offset from the axis 56 of the column 1. The axial forces in the bridge will cause torques to be applied to the column when the axis of the bridge does not intersect the axis 56 of the column 1 or where transverse forces are applied via the bridge to the column as would be the case if the conventional A-frame type bridge is used. Also friction forces in the hinges of the universal joint 22 connecting the bridge to the column can cause torque forces in the column. Furthermore where the column shape or weight is not disposed symmetrically about its axis 56 environmental loading upon the column and accelerations of the column resulting from its swaying motion produce additional moments about the axis 56 that have to be resisted by the universal joint. Referring again to FIG. 9, it will be seen that the spindles 49, 50 53, 54 will resist such torque and prevent rotation of the column. If a conventional universal joint were used, wherein a single yoked pair of lugs is provided for each axis of rotation 48, 52 and such yoked lugs are position symmetrically about the column axis 56, the forces applied to the bearings housed within these yoked lugs could be so large as to render such a concept impractical.

Alternatively the coupler piece that houses the spindles would have to be of such large dimensions as to render the design uneconomic.

The cardan joint 41 is configured to resist the worst storm considered likely to occur within a period of a hundred years and thus is expected to last for the full life of the column. However, in the event of breakage of a component in the joint, a potentially environmentally disastrous situation could occur in which the universal joint assembly breaks up and the risers are broken as a result of the column 1 moving away from the base 5. To prevent this occurring, the ball joint 42 is provided.

The ball joint is preferably designed to resist primarily only forces in line with the axis of the column 56 as lateral forces applied to the articulation can be transmitted through to the base by the remaining intact components of the joint assembly.

Referring to FIG. 11, the joint 42 includes preferably a steel ball member 57 with an upwardly extending tubular extension 58. The ball member 57 is located on the same axes of rotation as the cardan joint 41 and is received within a socket 59 defined by a pair of bronze bushings 60, 61 received in the end of a tubular support 62 attached to the central part of the H-beam 43 (FIG. 8). The ball member is overlaid with a suitable wear resistant and non-corrosive material where it makes contact with the bronze bushing 60, 61.

Referring now to FIGS. 10, 11 and 12, this shows the column foot beam 45 in more detail. It comprises a box sectioned generally hexagonal beam attached to the base of the legs 19 and has a generally hexagonal central opening 63. This opening 63 is bridged by a steel latticework structure 64 which supports a bearing tube 65 coaxial with the axis 56 of the column 1. The tubular extension 58 of the ball joint is slidably received in the tubular bearing tube 65. The top end of the tubular extension 58 is provided with a cap 66A to prevent it being pulled completely through the tubular support 65 in the event that universal joint 41 breaks and the column rises relative to the base. Similarly an outer collar 66B is fixed to 58 to prevent it being pushed up through the tube 65 if the column falls relative to the base. Thus, in normal use, the ball joint 42 is not loaded by the buoyancy or weight of the column. However, in the event of breakage of the cardan joint 41, the column 1 will rise upwardly due to its buoyancy until the cap 66A on the tubular member 58 engages the tubular support 65, thus loading the ball joint 42. The cap 66A and collar 66B are positioned so that the amount of axial movement of the column required to engage the cup 66A or the collar 66B with the support 65 is not so large as to overstrain and thereby damage other intact parts of the articulation 14.

Since the ball joint 42 is normally unloaded, the bushings 60, 61 do not have to be designed to operate under high long term stress conditions and thus can be of practical dimensions and allow the use of relatively cheap materials such as bronze or the like. In the event that any single crack should develop and propagate across the whole section of a spindle or a lug or the cardan ring, a partial failure of the universal joint would occur. In the event that the crack were to be through the cardan ring 44 the ball joint 42 will restrict the upward or downward movement of the column to a value which does not cause the remainder of the cardan ring to fail. The cardan ring 44 is preferably dimensioned so that lateral forces and moments applied to the articulation can be safely transmitted through the damaged ring 44 via the yokes 57 to the base beam 43 without failure of the ring or of any other components of the universal joint. Preferably the housings for the spindles 49, 50, 53, 54 in the cardan ring 44, and the cardan ring itself are dimensioned so that whatever the position of the crack through the spindle or lug, the remaining intact structures should not fail as a result of the extra loads applied to them.

As shown in FIG. 12, the latticework 64 includes a transversely extending riser guide arrangement 67 which defines a plurality of slots 68 through which the risers 12 extend.

Referring now to FIGS. 13, 14, 15, 16 and 17, the manner in which the risers may bend upon movement of the column 1 will be described.

Figure 14:
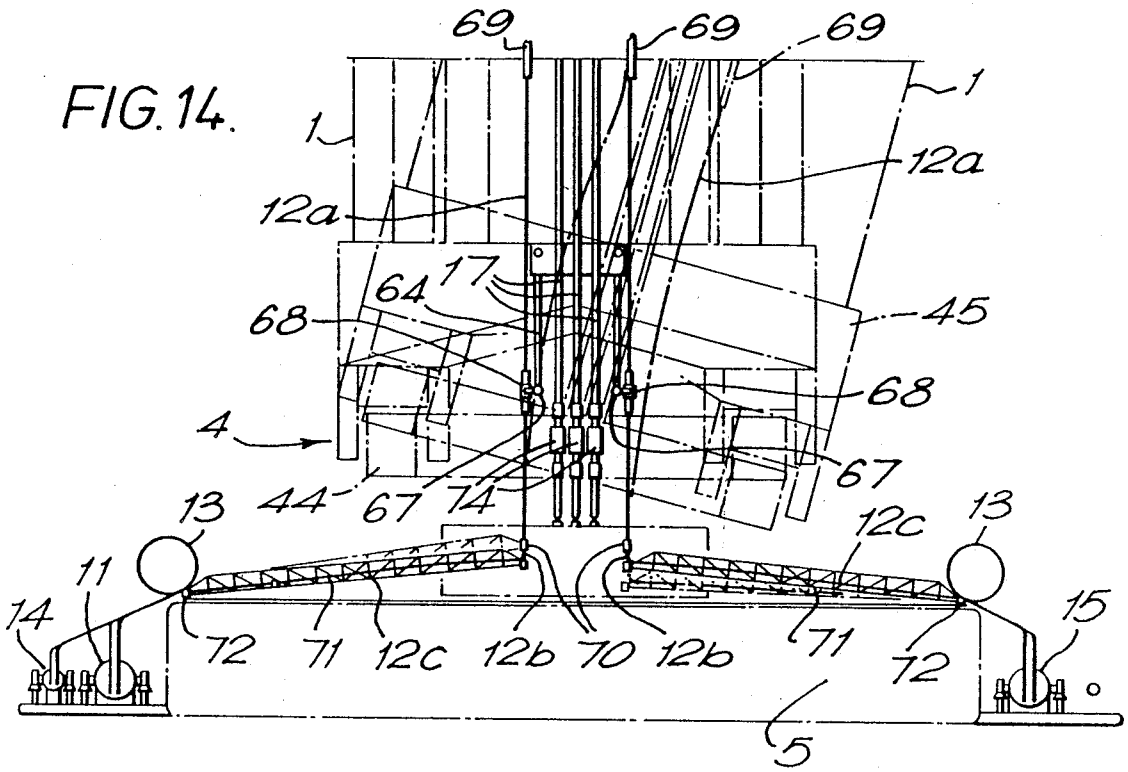
FIG. 14 is a schematic vertical section of the column 1 showing how the risers 12 can flex upon tilting of the column.

Referring to FIG. 15, the risers are contained within steel casings 69 which are effectively suspended from the top end of the column. Typically 24 riser casings 69 are provided for the risers 12 and a typical arrangement is shown in FIG. 15. The risers are desirably placed as close as possible to the vertical axis 56 of the column in order to minimise bending stresses as will be explained hereinafter. The risers typically are steel pipes of five inch internal diameter and the casings 69 are 13.375 inches outside diameter. Each casing may contain a plurality of risers and hydraulic tubes. In the example, each casing contains a five inch internal diameter production tube and a two inch internal diameter annulus access tube. Each pair of tubes serves an individual well. Casings 69 thus provide a rigid support for the risers 12. As shown in FIG. 14, the casings 69 terminate at the lower end of the column at a distance above the joint arrangement 4 in order to afford some flexibility to the lower end of the risers. The exposed portions of the risers 12*a* in the column 1 extend through the slots 68 in the riser guide arrangement 67 and terminate at a releasable connector 70. Each of the risers further includes curved portion 12*b* which extends from the connector 70 to a base portion 12*c* extending across the base and which leads into the circular portion 13. The flexibility of the smaller two inch line is sufficient for this circular portion to be omitted. The risers then run into the casings 10, 11, 14, 15 which extend to the wells as described previously with reference to FIG. 1.

The base portions 12*c* of the risers are each received in an individual cradle 71 which is pivoted at a point 72 at the outer edge of the base 5.

FIG. 14 shows how the riser arrangement can accommodate movement of the column about the joint arrangement 4. FIG. 14 shows the column in a vertically upright position in shaded outline and further shows the column in hatched outline deflected to the right as a result of sea motion. It will be seen that due to the fact that the riser portions 12*a* are exposed from the casing 69 they are free to flex in the region where they pass through the central opening in the joint arrangement 4. Also, because the base portions 12*c* are mounted on pivotally mounted cradles 71, to which they are attached by flexible mountings at only two points along the length of the cradle they can flex within the cradles and move up and down with the cradles to accommodate the column movement. The circular piping portions 13 provide additional resiliency to the arrangement. Thus, it is possible to implement the entire riser in metal pipe which overcomes the need for expensive and potentially unreliable ball joints or flexible hoses which tend to wear and require periodic replacement. It will be appreciated that such replacement is expensive and necessitates that oil and gas production be suspended while the replacement is carried out.

The riser portions 12*a* within the column 1 can be replaced by releasing the connectors 70 and raising the risers 12*a* through their respective casings by means of a gantry crane 73 (FIG. 1) on the top of the column 1.

As previously mentioned, the oil is pumped back down the column 1 through export lines 17 which extend along the seabed to a remote location. The export lines are of larger diameter than the risers, typically twelve inches and typically do not have sufficient flexibility to accommodate tilting of the column. The export lines 17 thus are provided with swivel ball joints 74 located as close as possible to the level of the axes of rotation of the articulation 48, 52. As shown in FIG. 17, the export line 17 portions include shutoff valves 75. Also as shown in FIG. 15, a ball joint retrieval casing guide 76 can be provided in the column to allow the ball joints 74 to be retrieved for servicing by means of the gantry crane 73 or a winch.

The export risers 17 are fixed at or near the top of the column and extend through guide slots at typically 15 meter intervals along the column in a similar way to that provided for the risers 12 to the wells. The ball joints 74 will thus rise and fall relative to the base 5 and the base connection beam 42 as a result of thermal expansion and contraction and also due to column swaying motions by virtue of their distance from the axis of the column 65. The upward and downward motion of the ball joints relative to the base causes the metal pipeline export riser section 17A to be flexed up and down. This section 17A is dimensioned such that the flexural stresses imposed in the piping by this movement do not cause failure.

In order to limit the stresses applied to the piping the ball joint lower part is mounted on a resilient mounting on the base connection beam 43 which will restrict the movement of the lower part of the ball joint to an upward and downward movement. This mounting may be as illustrated in FIG. 16 and may take the form of a post 77 running in a tube 78 set in the base connection beam 43. An alternative resilient support arrangement is the articulated cradle arrangement 71 shown in FIG. 15 for the production risers. It should be noted that the principal elements of the arrangement shown for the export riser 17 is applicable as an alternative also for the production risers 12 and vice versa.

FIGS. 18 and 19 show an alternative arrangement for the risers 12. The risers 12 and the control lines 18 may be grouped together in the riser casings 69. The casing 69 may terminate approximately 12 meters from the seabed in a stab-in connector 79 which is located inside and is latched to the 13.375" casing. The casing is supported by a sliding support permitting sliding motion along an axis parallel to the casing mounted on the outside of the column foot beam. A bundle of flow lines, typically two tubing lines and an associated control line 18 are connectible to the conduits in the casing 69 by means of the stab-in device 79. The flexible flowline bundle 80 is part of or is connected to appropriate flow lines 81, which are also flexible and which extend over a support member 82 arranged at the side of the base 5. The flexible line 81 is held by a retaining collar 83 on the support member 82.

The export lines 17 may be provided with similar flexible connections. It will be appreciated that the flexible line 81 will accommodate tilting movement of the column 1.

It will be appreciated the the various riser arrangements shown in FIG. 13 to 19 can be mixed on any one installation, It will be appreciated also that the riser and universal joint arrangements described herein can be used in comparison with column of different construction forms such as concrete or steel cylindrical columns of constant or varying diameter and that the columns associated with the riser and universal joint arrangements described herein may be used to support other functions such as wells and drilling equipment and/or act as a single point mooring for the production vessel. Similarly ship shaped type production vessels may also be used and different forms of bridge connection such as prior art A-frame bridges may be used.

I claim:

1. A system for offshore operations comprising a base for attachment to the seabed, a column for articulation to the base to extend upwardly therefrom, the articulation including first and second universal joints, the first universal joint including a plurality of relatively rotatable joint surfaces disposed radially outwardly of the longitudinal axis of the column whereby to provide an axial opening through the first joint, the second universal joint being disposed in said axial opening, the first and second joints being so arranged that normally the first joint is loaded by the column and said second joint is substantially unloaded, but in the event of failure of the first joint said second joint is arranged to assume the entire column load without failure thereof, and a plurality of risers extending longitudinally of the column through said space in the first universal joint for coupling to the seabed.

2. A system according to claim 1 wherein the universal joint comprises a column foot beam on the column, a cardan ring rotatably mounted on the column foot beam about a first axis, the ring also being mounted on the base for rotation about a second axis transverse to said first axis.

3. A system according to claim 2 wherein the cardan ring is mounted for rotation about the second axis on a base connection beam itself mounted on the base.

4. A system according to claim 2 wherein the second universal joint comprises a ball joint disposed axially of the column.

5. A system according to claim 4 wherein the ball joint comprises a ball member received in a socket member, said members being mounted on the base connection beam and the column foot beam.

6. A system according to claim 5 wherein, the ball member includes a tubular extension mounted for limited sliding movement relative to the column foot beam such that in normal operation, the load of the column is carried by the first universal joint but in the event of failure thereof, the column moves upwardly so as to produce a sliding movement between the column foot beam and the tubular portion of the ball member, until the second universal joint becomes loaded by the column.

7. A system according to claim 6 wherein the first universal joint including means that allow it even when broken to withstand lateral environmental loads applied to the column, so that the second joint is only called upon to resist load components parallel to the column axis.

8. A system for offshore operations, comprising a base for attachment to the seabed, a buoyant column articulated to the base by a universal joint so as to extend from the base toward the sea surface, the universal joint having an opening therein along the axis of the column, at least one riser including a column portion extending along the column, a base portion extending across the base and a portion joining the base portion and the column portion, said portions all being formed of metal tube and being so arranged that they can accommodate rocking movement of the column without fracture and without ball joints or flexible hoses.

9. A system according to claim 8 wherein the base portion of the riser is received on a cradle rotatably mounted on the base to allow movement of the riser due to rocking motion of the column about the universal joint.

10. A system according to claim 9 wherein the base portion of the riser includes a loop portion adjacent the rotational axis of the cradle.

11. A system for offshore operations according to claim 1, wherein the column is connected to a base by a hollow universal joint, with piping extending over the base and connected to piping within the column by means of at least one pivotal pipe joint within the universal joint wherein said column is hollow.

12. A system according to claim 11 wherein said pivotal joint comprises a ball joint.

13. A system according to claim 12 wherein the ball joints are arranged on resilient mounts to accommulate vertical movement of the piping upon rotational movement of the column.

14. A system for offshore operations comprising a base for attachment to the seabed, a control column extending upwardly from the base, the column being articulated by a universal joint to the base, a semisubmersible structure, and a bridge between the column and the structure, the bridge being connected to the semisubmersible structure by a joint arrangement which permits rotation of the bridge relative to the structure about both a substantially vertical axis and a substantially horizontal axis.

15. A system according to claim 14 wherein the joint arrangement also permits relative rotation of the bridge and the semisubmersible structure about the longitudinal axis of the bridge.

16. A system according to claim 15 wherein the bridge is connected to the semisubmersible structure by a releasable hook. .

17. A system according to claim 16 wherein the releasable hook includes a generally horizontal pin on the bridge, and a hook arrangement on the semisubmersible structure, the hook arrangement includes receptacles in which the pin is releasably received for pivotal movement.

18. A system according to claim 16 including a hydraulic catch so arranged that the pin is released from the hook arrangement by downward movement upon release of the catch, winch means on the semisubmersible, and a cable extending from the winch means to the bridge for manoeuvring the bridge.

* * * * *